United States Patent [19]

Toishi

[11] Patent Number: 4,494,292

[45] Date of Patent: Jan. 22, 1985

[54] METHOD FOR SECURING BOTTOM END STOP TO FASTENER CHAIN

[75] Inventor: Yoshiyuki Toishi, Toyama, Japan

[73] Assignee: Yoshida Kogyo K. K., Tokyo, Japan

[21] Appl. No.: 449,514

[22] Filed: Dec. 13, 1982

[30] Foreign Application Priority Data

Dec. 29, 1981 [JP] Japan ..... 56-214770

[51] Int. Cl.[3] ..... B21D 53/50; A41H 37/06

[52] U.S. Cl. ..... 29/408; 29/33.2; 29/766; 29/767

[58] Field of Search ..... 29/408, 33.2, 766, 767

[56] References Cited

U.S. PATENT DOCUMENTS

| | | | |
|---|---|---|---|
| 2,096,685 | 10/1937 | Osgood | 29/767 |
| 3,872,571 | 3/1975 | Douri | 29/767 |
| 4,236,292 | 12/1980 | Orr et al. | 29/408 |
| 4,307,511 | 12/1981 | Yoshida | 29/767 |
| 4,368,570 | 1/1983 | Morita | 29/408 |

*Primary Examiner*—Howard N. Goldberg

*Assistant Examiner*—Steven E. Nichols

*Attorney, Agent, or Firm*—Hill, Van Santen, Steadman & Simpson

[57] ABSTRACT

A method and apparatus for securing a bottom end stop to an indefinite length of fastener chain including alternately space portion where elements are removed and engaging element portion are disclosed. The feeding movement of the fastener chain is arrested by protruding a chain stopper into the space portion downstream of one of the element portions while slidably guiding and opposite edges of the element portions. The fastener chain is then resiliently held down at its space portion or element portion downstream of the space portion by an element stopper and the chain stopper is pulled out of the space portion. By this, the fastener chain is allowed to move until its element portion upstream of the space portion abuts against the element stopper, where upon a bottom end stop is driven into the end of the element portion upstream of the space portion.

3 Claims, 11 Drawing Figures

Fig. 4(a)
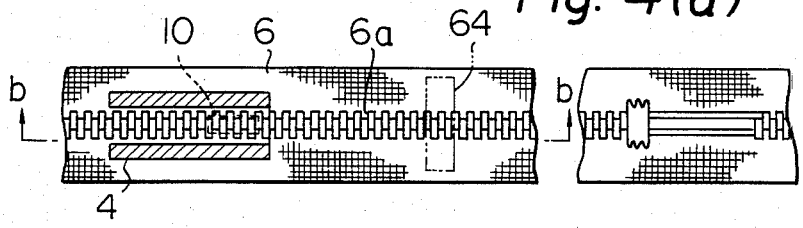
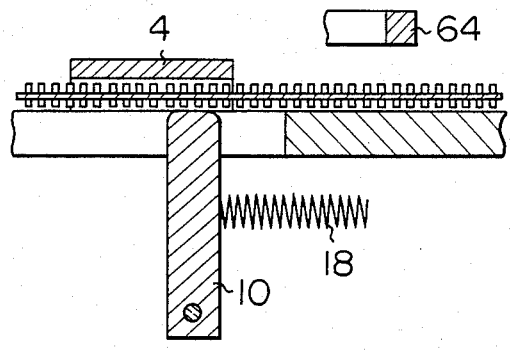
Fig. 4(b)
Fig. 5(a)
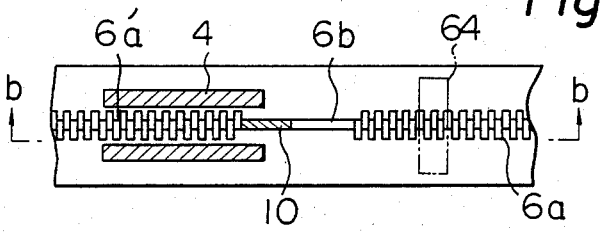
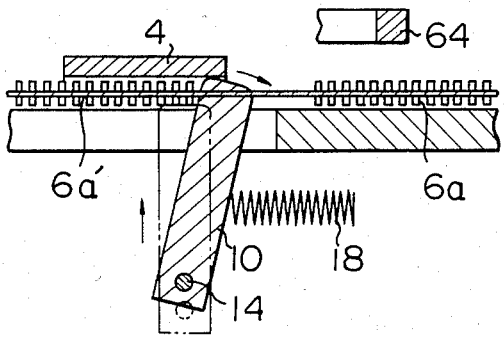
Fig. 5(b)

Fig. 6(a)
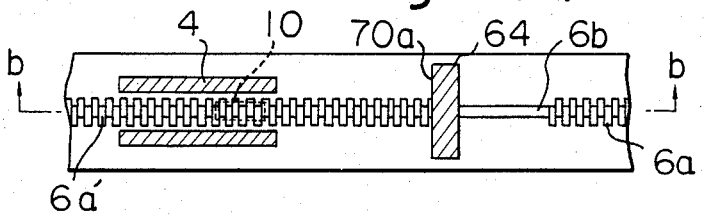
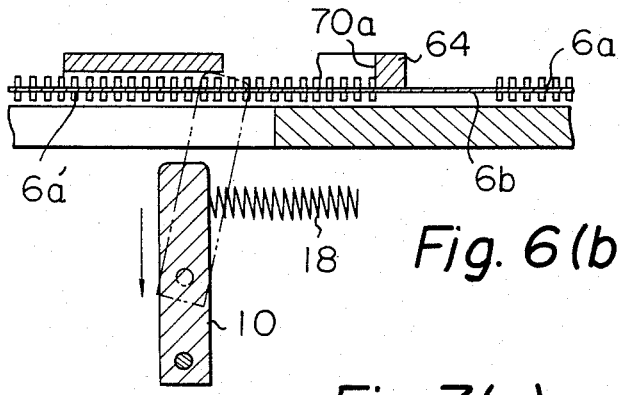
Fig. 6(b)
Fig. 7(a)
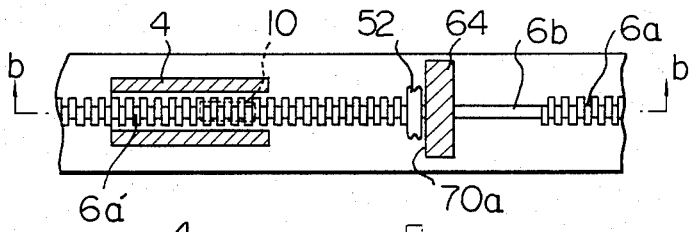
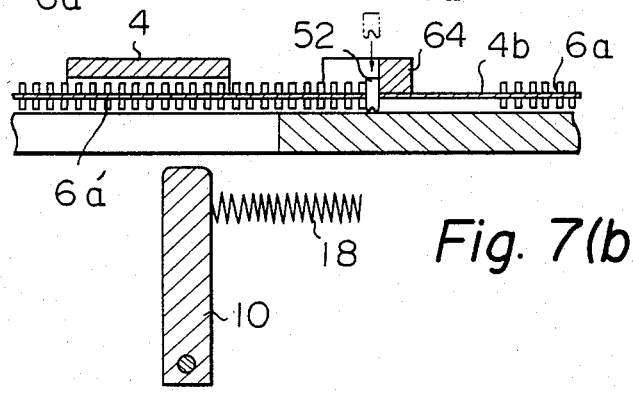
Fig. 7(b)

METHOD FOR SECURING BOTTOM END STOP TO FASTENER CHAIN

FIELD OF THE INVENTION

This invention relates to a method and an apparatus for securing a bottom end stop to an indefinite length of fastener chain.

BACKGROUND OF THE INVENTION

Hithertofore, in order to continuously and automatically secure a bottom end stop to one end of each element portion of an indefinite length of fastener chain having alternately engaging element portion and space portion formed thereon, a stopper is protruded into a selected one of the space portions of the chain while the chain is moving at a high speed to arrest the movement of the chain, a separately formed bottom end stop is transferred to and positioned at the end of a selected one of the element portions of the chain which is standing still and the bottom end stop is then driven into the chain by a press or the like to be secured to the chain in bent condition. Such method is disclosed in U.S. Pat. No. 2,096,685.

However, the prior art method has the disadvantage that in order to arrest the movement of the fastener chain moving at a high speed, the stopper is protruded into a selected space portion on the fastener chain to cause the stopper and the engaging fastener elements upstream of the space portion to abut against each other to thereby halt the movement of the chain and thus, the engaging fastener elements frequently tend to cause splitting resulting in interruption of the operation. And according to the above-mentioned prior art method, since the fastener chain halts its movement when the engaging elements upstream of the space portion resiliently strike against the stopper, the ultimate halting position of the engaging elements can not be easily adjusted and as a result, the bottom end stop is frequently secured to the end of the element portion in a position other than the predetermined position.

SUMMARY OF THE INVENTION

The present invention is to eliminate the above-mentioned disadvantages and for that purpose, according to the present invention, in order to secure a bottom end stop to an indefinite length of fastener chain including alternately space portion where elements are removed and engaging element portion, a chain stopper is protruded into the space portion downstream of a selected one of said element portions while the engaging element portions of the fastener chain fed on the machine base are being slidably guided at the opposite side edges of the element portions to arrest the movement of the fastener chain, the space portion or the element portion downstream of the space portion is resiliently pressed down and held by an element stopper, the chain stopper is pulled out of the space portion to thereby allow the chain to move until the end of the engaging element portion upstream of the space portion abuts against the element stopper and driving a bottom end stop into the end of the element portion upstream of the space portion to thereby prevent the chain from splitting due to the abutment by the chain stopper and hold down the most downstream element in the element portion in a predetermined position to thereby always secure the bottom end stop in a predetermined position of the fastener chain.

BRIEF DESCRIPTION OF THE DRAWINGS

FIGS. 4 through 7 are fragmentary views showing the operation of the chain stopper and element stopper in which FIGS. 4*a*, 5*a*, 6*a* and 7*a* are plan views and FIGS. 4*b*, 5*b*, 6*b*, and 7*b* are cross-sectional views taken along line b—b of FIGS. 4*a*, 5*a*, 6*a* and 7*a*, respectively.

PREFERRED EMBODIMENT OF THE INVENTION

Figure 1:
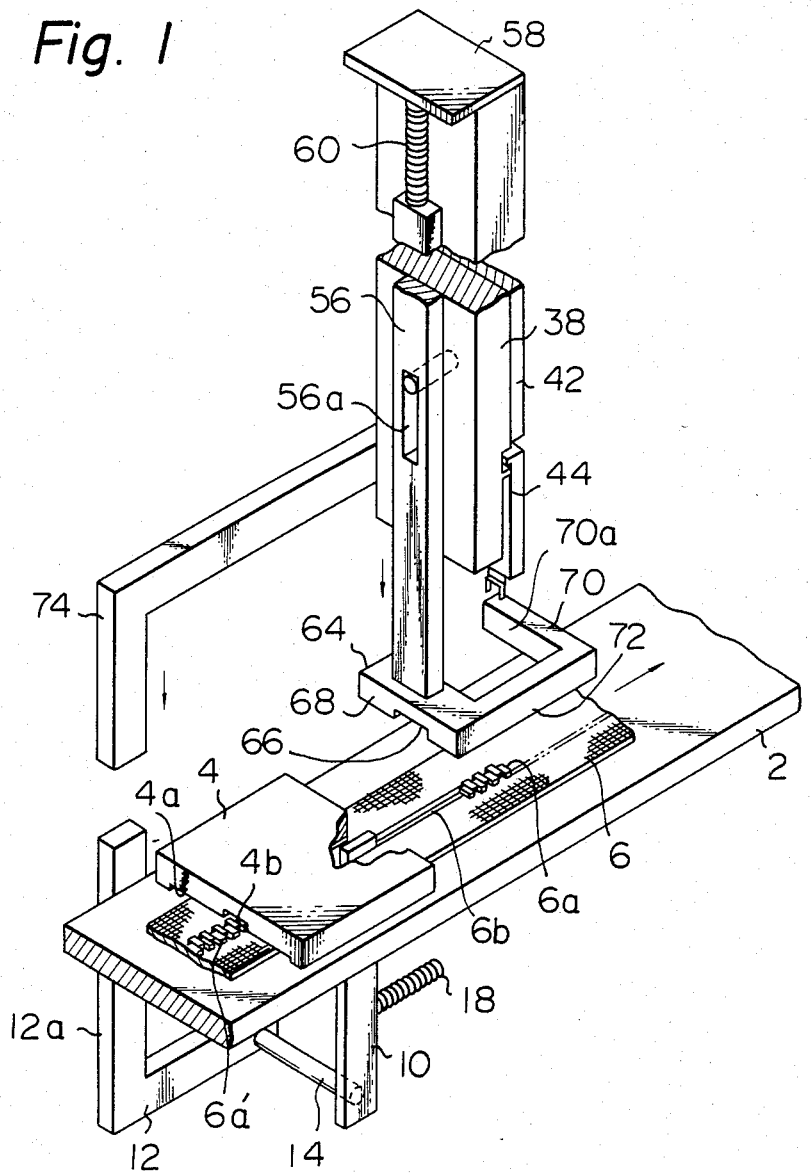
FIG. 1 is a schematic perspective view of the entire of apparatus of the present invention.
Figure 2:
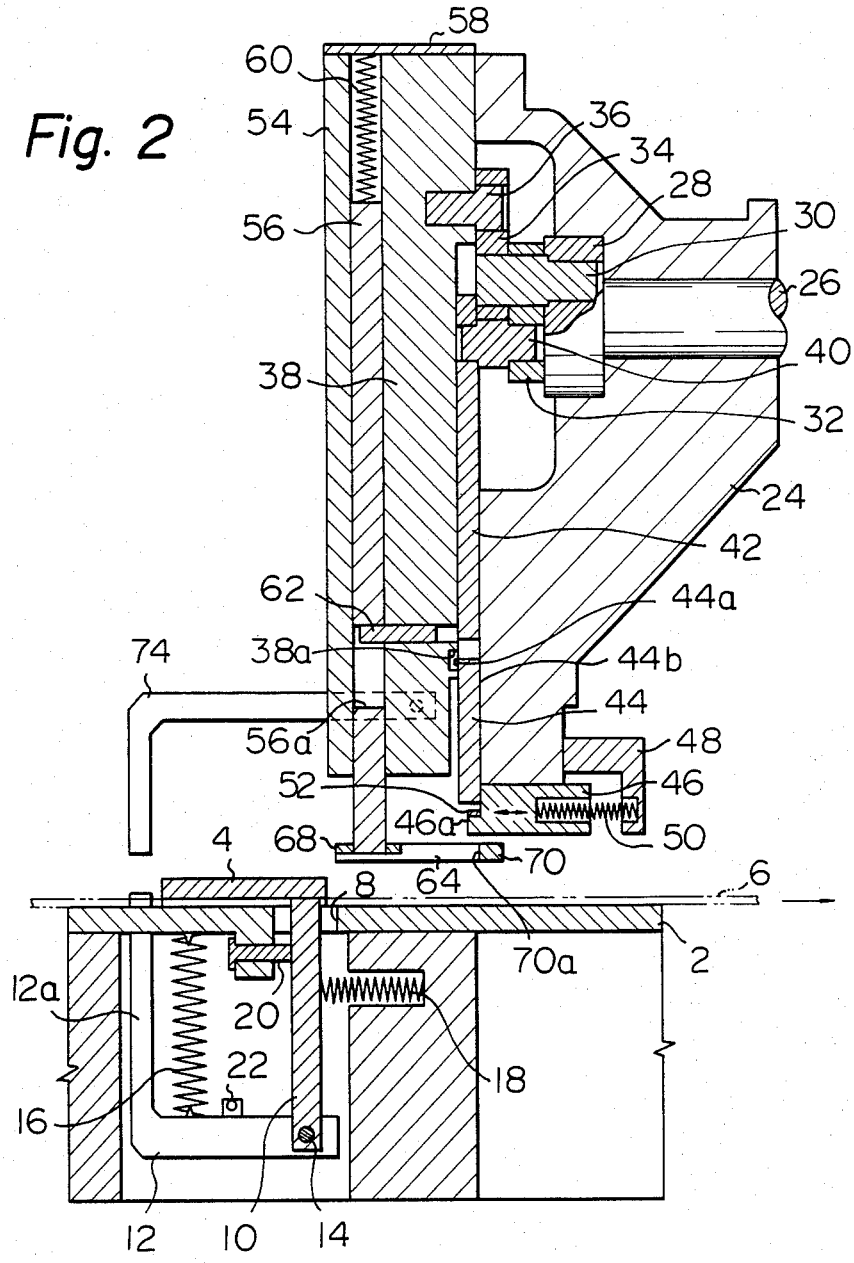
FIG. 2 is a cross-sectional view of the apparatus shown in FIG. 1.

The present invention will now be described referring to the accompanying drawings in which one preferred embodiment of the invention is shown:

FIGS. 1 and 2 schematically show the entire embodiment of apparatus. A chain guide 4 is fixedly secured to the top of a machine base 2 and an indefinite length of fastener chain 6 including alternately engaging element portion 6*a* and space portion 6*b* is moved through the chain guide 4 in the arrow direction by means of transfer means (not shown). The chain guide 4 has a tape guide portion 4*a* and an element guide portion 4*b* which is adapted to slidably guide the opposite side edges of the fastener elements of the chain.

Provided below the chain guide 4 is a chain stopper 10 adapted to project upwardly through an opening 8 formed in the machine base 2. That is, the chain stopper 10 is pivoted at the lower end thereof to a pivot pin 14 which is in turn secured to the horizontal portion of an L-shaped guide 12 below the machine base 2 and the L-shaped guide 12 is normally pulled upwardly by a spring 16 anchorded to the machine base 2 and to the guide 12. The chain stopper 10 is normally urged to abut against the stopper 20 on the machine base 2 by means of a spring 18 extending between the stopper 10 and machine base 2. The raised position of the L-shaped guide 12 and accordingly, the upwardly projected position of the chain stopper 10 is limited by the engagement between the L-shaped guide 12 and a stopper 22 on the machine base 2 and in this upwardly projected position, the upper end of the chain stopper 10 abuts against the undersurface of the chain guide 4. The projection and retraction of the chain stopper 10 through the opening 8 is effected by pushing and releasing the upper end of the vertical portion 12*a* of the L-shaped guide 12 respectively by a chain stopper pushing-down means 74 as will be described hereinafter.

As stationary frame 24 is provided above the machine base 2 and has a horizontal rotary shaft 26 journalled therein to be driven by a motor (not shown). A boss 28 is secured to one end of the rotary shaft 26 coaxially with the shaft. The boss 28 has one end of an eccentric and horizontal pin 30 rotatably secured thereto and links 32 and 34 are rotatably supported at one end thereof in an intermediate position and at the other end of the pin 30, respectively. The other end of the link 34 is connected through a pin 36 to a punch holder 38 which is provided within the stationary frame 24 for upward and downward movement therein and the other end of the link 32 is connected through a pin 40 to the upper end of a punch 42 which is provided between the stationary frame 24 and punch holder 38 for upward and downward movement. A folding punch 44 is provided below the punch 42 in vertical alignment therewith and adapted to slide upwardly and downwardly and the folding punch 44 is formed at the upper end thereof with an engaging projection 44*a* adapted to engage in a mating recess 38*a* formed in the punch holder 38 so that the folding punch 44 is held in position by the punch holder 38.

The lower end of the stationary frame 24 supports a bender 46 for slidable horizontal movement and the bender is normally biased towards the folding punch 44 by a compressed spring 50 held between the bender and a spring holder 48 secured to the stationary frame 24. The die 46*a* of the bender 46 is adapted to receive thereon successive bottom end stops 52 each of which is formed by cutting off and bending a portion cut from an indefinite length of flat square wire by the coaction of a cutter and the punch (not shown) each time the punch holder 38 descends. When the punch holder 38 descends the bender 46 is retracted against the force of the spring 50 by a cam mechanism (not shown) provided between the punch holder 38 and bender 46 and the folding punch 44 grips the bottom end stop 52 on the die 46*a* and drives the same into the chain 6 on the machine base 2.

Provided between the punch holder 38 and a cover 54 secured to the stationary frame 24 is a guide 56 for upward and downward slidable movement and a compression spring 60 is interposed between the upper end of the guide 56 and a plate 58 secured to the top of the stationary frame 24 to urge the guide 56 downwardly. The guide 56 is formed in an intermediate position between the opposite ends thereof with a slot 56*a* for loosely receiving a pin 62 secured to the punch holder 38. Secured to the lower end of the guide 56 is a U-shaped element stopper 64 which includes a front portion 68 formed on the undersurface thereof with a notch 66 for passing the fastener elements on the chain 6 therethrough, a rear portion 70 having the plain undersurface and an intermediate portion 72 connecting the portions 68, 70 together. As more clearly shown in FIG. 2, the element stopper 64 is disposed downstream of and adapted to descend to a position adjacent to the chain guide 4 and the inner side face 70*a* of the rear portion 70 which forms element stopper is in vertical alignment with the outer side face 44*b* of the folding punch 44.

The punch holder 38 has in a lower portion thereof an L-shaped arm 74 secured thereto for vertical movement with the punch holder and the vertical portion of the arm is in vertical alignment with the vertical portion 12*a* of the L-shaped guide 12 to provide a pushing-down means for the chain stopper 10.

With the above-mentioned construction and arrangement of the components of the apparatus, the operation of the apparatus will now be described. The indefinite length of fastener chain 6 is moved on the machine base 2 by a feed mechanism (not shown). While the element portion 6*a* of the chain 6 is being passed over the chain stopper 10, the chain stopper 10 is in abutment against the fastener elements on the undersurface of the tape under the pushing up force of the spring 16 as shown in FIGS. 4*a* and 4*b*. And the punch holder 38 is held in the raised position as shown in FIG. 1 whereby both the element stopper 64 and folding punch 44 are similarly raised up.

The chain 6 continues to move until the space portion 6*b* reaches over the chain stopper 10 whereupon the chain stopper 10 protrudes upwardly through the clearance between the left- and right-hand tape portions of the space portion 6*b* and is engaged by the leading element of the engaging element portion 6*a*′ upstream of the space portion 6*b* whereby the chain stopper 10 is pivoted about the pin 4 in the chain feed direction against the force of the spring 18 as shown in FIGS. 5*a* and 5*b* and the movement of the chain is stopped. At this time, a plurality of elements in the engaging element portion 6*a*′ abutting against the chain stopper 10 are guided on the opposite side edges thereof by the chain guide 4 and thus, the chain is prevented from splitting. And when the chain stopper 10 is pivoted as shown in FIG. 5*b*, a limit switch (not shown) in abutment against the chain stopper 10 is actuated to energize a motor (not shown) which in turn rotates the rotary shaft 26 whereby the punch holder 38 connected through the pin 30, link 34 and pin 36 to the boss 28 at the end of the rotary shaft 26 and the punch 42 connected through the pin 30, link 32 and pin 40 to the boss 28 are caused to descend, respectively and at the same time, the L-shaped arm 74 secured to the punch 38 and the guide 56 biased downwardly under the force of the spring 60 also descend in unison. At this time, the cutter and punch (not shown) on the punch holder 38 cut a length portion corresponding to one bottom end stop 52 off an indefinite length of flat square wire and then bend the cut portion on the die 46*a* on the bender 46 to produce the bottom end stop.

Figure 3:
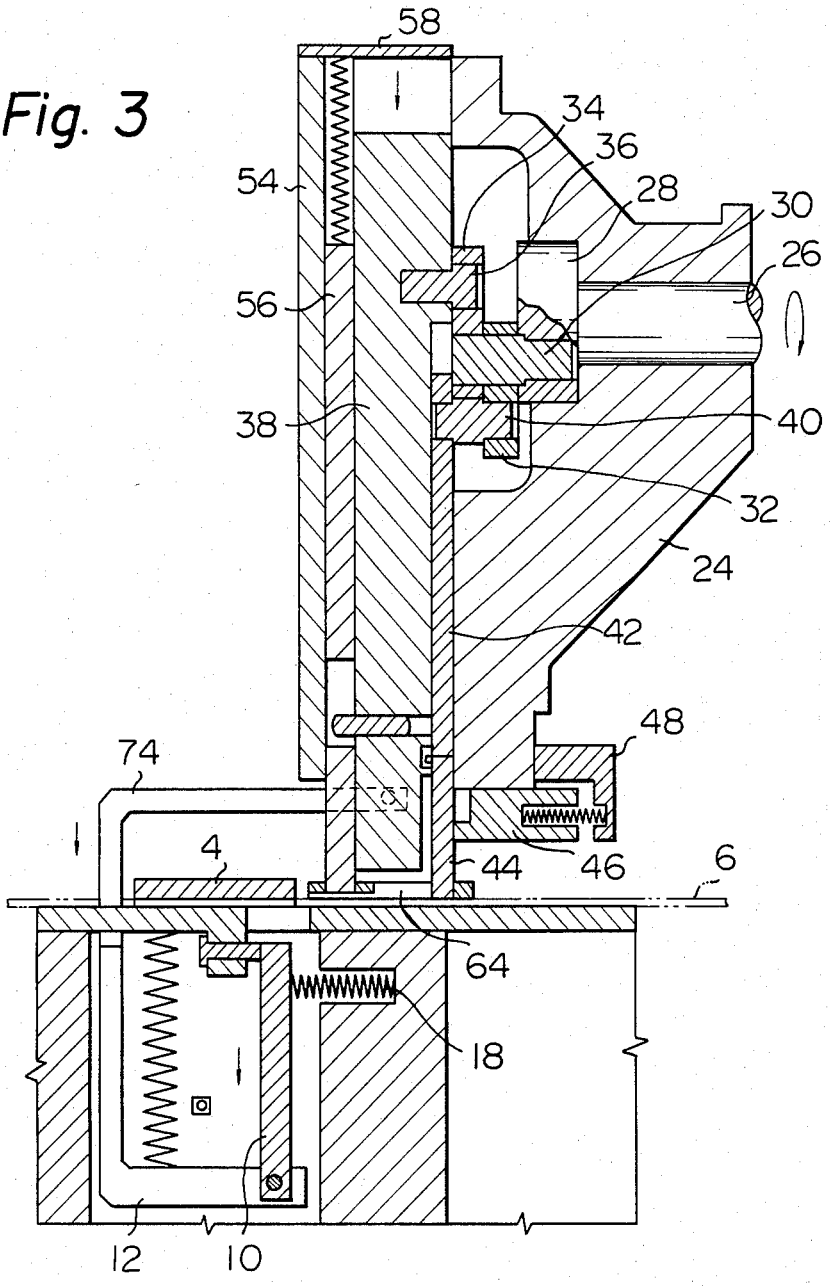
FIG. 3 is similar to FIG. 2, but shows the apparatus in a different operative position.

As the punch holder 38 descends, the guide 56 also descends whereupon the element stopper 64 at the lower end of the guide 56 resiliently holds down the element portion 6*a* positioned downstream of the space portion 6*b* of the chain 6 the movement of which has been stopped by the chain stopper 10 and has the bottom end stop 52 secured thereto already and at the same time, or after a slight time lag, the vertical portion of the L-shaped arm 74 pushes the vertical end portion of the L-shaped guide 12 to disengage the chain stopper 10 from the space portion 6*b* (FIG.3). At this time, the chain moves a small distance (about 6–10 mm) under the tension on the chain and the leading element of the element portion 6*a*′ upstream of the space portion 6*b* abuts against the stop face 70*a* of the element stopper 64 to arrest the movement of the chain (FIGS. 6*a* and 6*b*). Thus, the end of the element portion 6*a* to which the bottom end stop 52 is to be secured is positioned in a predetermined proper position. And at this time, the folding punch 44 holds the bottom end stop 52 formed and held on the bender 46 and the bender 46 is then retracted by the cam mechanism (not shown). Furthermore, as the punch holder 38 descends, the punch 42 presses against the head of the folding punch 44 to secure the bottom end stop 52 held at the lower end of the folding punch 44 to the end of the element portion 6*a* on the chain 6 (FIGS. 7*a* and 7*b*). At this time, the links 32 and 34 are at the lower dead point. As the rotary shaft 26 further continues to rotate, the punch holder 38, L-shaped arm 74, guide 56, folding punch 44 and punch 42 ascend and at the same time, the chain stopper 10 also ascends to return to the initial position whereupon the rotation of the shaft 26 ceases. By repeating the operation sequence as described hereinabove, the successive bottom end stops can be automatically secured to the ends of the successive element portions of the indefinite length of fastener chain.

In the illustrated embodiment, although the element stopper 64 is designed to press against the element portion *6a* downstream of the space portion *6b*, the element stopper may be designed to press against the space portion *6b* itself.

As clear from the foregoing description of the embodiment of the invention, according to the present invention, in order to secure the bottom end stop to the indefinite length of fastener chain, the elements of the chain are slidably guided and the element portions are caused to abut against the chain stopper to arrest the movement of the chain and thus, when the chain is stopped, the chain is prevented from splitting and furthermore, since the stop position of the elements is determined by the element stopper after the termination of the movement of the chain, the position of the end of the element portion to which the bottom end stop is to be secured is properly determined to thereby eliminate the possibility of production of unacceptable goods.

I claim:

1. A method for securing a bottom end stop to an indefinite length of fastener chain including alternating engaged fastener element portions and space portions where fastener elements are removed, comprising the steps of feeding said indefinite length of fastener chain in a longitudinal direction, protruding a chain stopper into each space portion downstream of one of said fastener element portions as the fastener chain is being fed to arrest the move of the fastener chain as said engaged element portion upstream of said space portion abuts said chain stopper, passing said engaged element portions through a guide means adjacent said chain stopper for slidably engaging the opposed lateral side edges of the engaged fastener elements to prevent fastener element separation upstream of said chain stopper, resiliently pressing down on one of said space portion or element portion downstream of said space portion with an element stopper means, pulling said chain stopper out of said space portion to thereby allow the fastener chain to move in said longitudinal direction until said engaged element portion upstream of said space portion abuts against a stop wall of said element stopper, and securing a bottom end stop to the end of said engaged element portion upstream of the space portion adjacent said stop wall while said fastener chain is prevented from moving.

2. The method of claim 1 in which said arresting of the movement of the fastener chain by protruding said chain stopper into said space portion is resiliently effected.

3. The method of claim 1 in which said protruding said chain stopper into said space portion is effected by resiliently abutting said chain stopper on the undersurface of said fastener chain with a pushing up force while said fastener chain is being fed.

* * * * *